US009316365B1

(12) United States Patent
Ko

(10) Patent No.: US 9,316,365 B1
(45) Date of Patent: Apr. 19, 2016

(54) RETROFIT SOLAR POWERED LIGHTING ASSEMBLY FOR FLAGPOLE

(71) Applicant: Gordon Ko, Phillips Ranch, CA (US)

(72) Inventor: Gordon Ko, Phillips Ranch, CA (US)

( * ) Notice: Subject to any disclaimer, the term of this patent is extended or adjusted under 35 U.S.C. 154(b) by 109 days.

(21) Appl. No.: 14/242,719

(22) Filed: Apr. 1, 2014

(51) Int. Cl.

| | |
|---|---|
| ***F21L 4/02*** | (2006.01) |
| ***F21L 13/00*** | (2006.01) |
| ***F21L 4/08*** | (2006.01) |
| *F21W 131/103* | (2006.01) |
| *F21V 21/116* | (2006.01) |

(52) U.S. Cl.
CPC ... *F21L 4/02* (2013.01); *F21L 4/08* (2013.01); *F21L 13/00* (2013.01); *F21V 21/116* (2013.01); *F21W 2131/103* (2013.01)

(58) Field of Classification Search
CPC F21W 2131/103; F21V 21/002; F21V 21/02; F21V 21/08; F21V 21/108; F21V 21/116; F21V 17/00; F21V 17/02; F21S 8/085; F21S 8/086; G09F 13/12; G09F 13/18; G09F 17/00; G09F 2017/005; E04H 17/20; F21L 4/02; F21L 4/08; F21L 13/00
USPC ..... 248/125.7, 219.2, 219.3, 289.11; 362/192, 431, 812
See application file for complete search history.

(56) References Cited

U.S. PATENT DOCUMENTS 1,029,404 A * 6/1912 Schumacher ..... F16L 37/252 285/360
1,296,060 A * 3/1919 Ferguson ..... B62J 6/02 248/220.22
1,748,625 A * 2/1930 Troth ..... E04H 12/32 116/173
1,974,080 A * 9/1934 Marker ..... F21V 21/116 174/45 R
3,476,929 A 11/1969 Klinger
3,508,731 A * 4/1970 Jablonski ..... F21V 21/116 248/219.2
3,586,280 A * 6/1971 Parduhn ..... F21V 21/116 248/214
3,959,645 A * 5/1976 Patry ..... F21V 21/116 211/107
4,228,489 A 10/1980 Martin
4,237,530 A 12/1980 Murray
5,266,738 A * 11/1993 MacVoy ..... E04H 12/08 174/45 R
5,975,727 A * 11/1999 Morstein ..... F21V 21/108 248/219.2
6,227,683 B1 5/2001 Tukia
7,275,495 B2 10/2007 Lawrence et al.
7,699,508 B2 4/2010 Schroeder
8,061,666 B1 * 11/2011 Fortin ..... F21S 8/086 248/219.1
8,069,811 B2 12/2011 Ciaccia (Continued)

*Primary Examiner* — Jong-Suk (James) Lee
*Assistant Examiner* — Colin Cattanach

(57) ABSTRACT

The present invention is an assembly that changes retrofits a flagpole with a solar powered area light, whereby the flag is removed from connection with the residential flagpole and stored. The assembly optionally includes a remote control so that a user can select from a number of operational modes for area lighting. The assembly also includes support bar connectors formed from two parts that are usable in either a connection of a support bar to the top of the flagpole or for connecting the support bar to the top of a downward directed solar lighting fixture.

13 Claims, 9 Drawing Sheets

(56) References Cited

U.S. PATENT DOCUMENTS

2006/0087852 A1* 4/2006 Richmond ..... F21S 9/037 362/374
2008/0232094 A1* 9/2008 Ramsdell ..... F21S 8/088 362/153
2010/0141153 A1* 6/2010 Recker ..... H05B 33/0803 315/149
2010/0254134 A1* 10/2010 McCanless ..... F21S 8/088 362/235
2010/0271802 A1* 10/2010 Recker ..... H05B 33/0803 362/20
2010/0309673 A1* 12/2010 Liu ..... F21S 8/086 362/427
2010/0327766 A1* 12/2010 Recker ..... H02J 9/02 315/291
2011/0002132 A1* 1/2011 Park ..... F21V 21/15 362/429
2012/0218758 A1* 8/2012 Wang ..... F21S 8/086 362/244
2012/0314404 A1 12/2012 Harshaw
2013/0100672 A1* 4/2013 Park ..... F21S 8/086 362/249.02
2014/0016309 A1* 1/2014 Toner ..... F21V 21/0885 362/183
2014/0085909 A1* 3/2014 Ahn ..... F16M 11/10 362/382
2014/0104836 A1* 4/2014 Kinnune ..... F21V 29/74 362/249.02
2014/0211459 A1* 7/2014 Toner ..... E04H 12/32 362/183

* cited by examiner

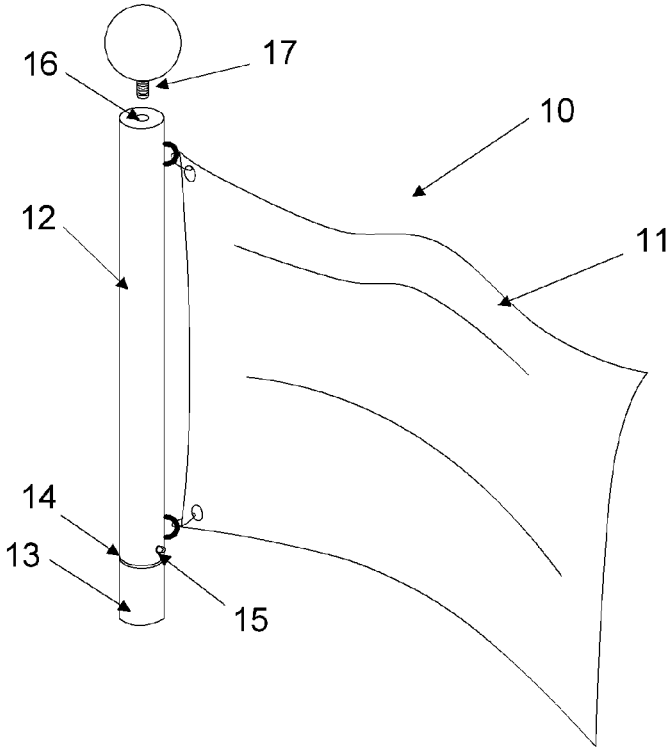
FIG. 1 - PRIOR ART
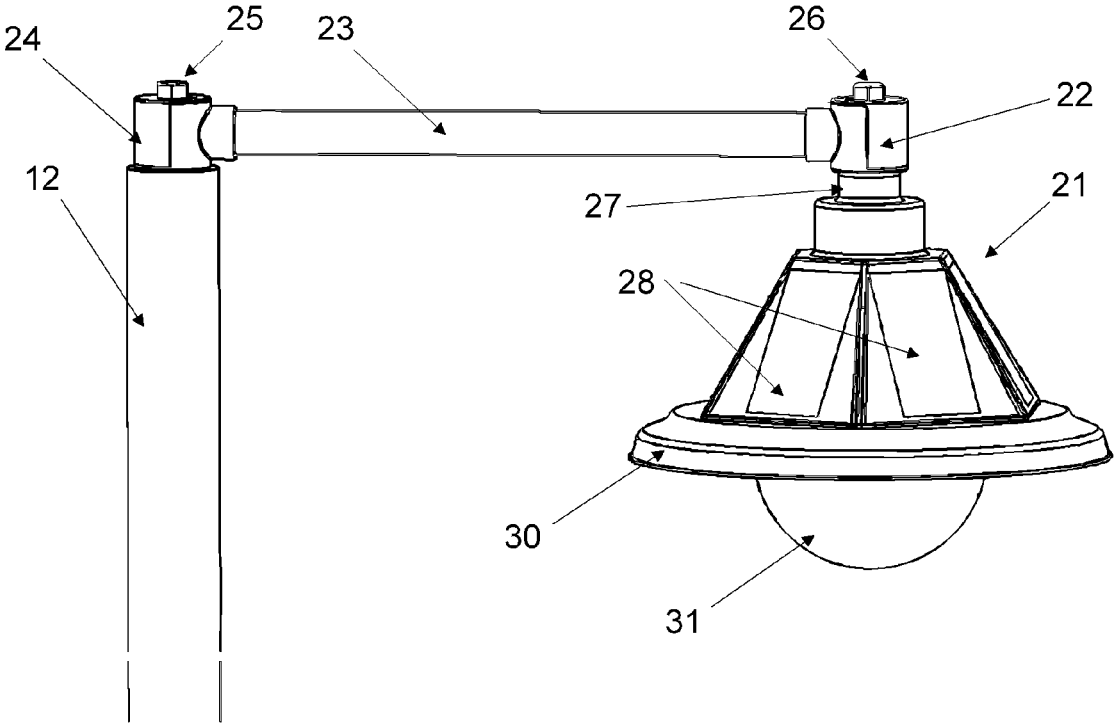
FIG. 2

RETROFIT SOLAR POWERED LIGHTING ASSEMBLY FOR FLAGPOLE

FIELD OF THE INVENTION

The present invention relates to solar powered outdoor lighting, specifically that type of lighting elevatable to above the height of humans.

BACKGROUND OF THE INVENTION

The traditional flagpole is well known in the art. It comprises a much elevated pole fixed at a base, from which pole a pennant or flag can be attached and displayed. U.S. Pat. Nos. 3,476,929 and 4,237,530 discloses that for quite some time, those skilled in the art have been attempting to place lights at the top of tall poles by respectively either attaching a dome light above an adjacent flag or to provide a lighting array that can be lifted into position with the flag removed. U.S. Pat. No. 6,155,696 continued the effort of the '530 patent to raise and lower a lighting array from a ground level to U.S. Pat. No. 6,227,283, 7,275,495 and D652,975 and US Application Pub. 2012/0314404 disclose other dome lights for the top ends of flagpoles. The focus of lighting at the tops of flagpoles has been to illuminate the flags, i.e., the dome lights provide an umbrella-like lighting generally incapable of substantial illumination of the distant ground surrounding the flagpole. This is well explained in the '495 patent:

"Pole-mounted flags, banners, pennants and the like, whether representative of a nation, company, university, athletic team, or other organization, represent a source of pride to those who display them. Generally, such flags and the like cannot be adequately displayed at night because of poor visibility. Because many people would prefer that their flag be seen at all times of the day or night and at any time of the year, it is common to try to illuminate such flags so that they are always visible."

A category of flagpoles have generally been available for many years for residential users. Due to a desire for minimal base support construction at a residence and zoned height limits, flagpoles for residential users are lightweight, have relatively small diameters, and are sometimes made of segments that are detachable to achieve a height desired by a residential user or to take the flagpole down entirely in long seasons of bad weather when a flag would not be used. Residential height flagpoles as described herein are generally between 7 to 25 feet in height and are capable of being erected or taken down by a one or two people from a fixture base of a concrete block or pad, a tire mount, a dock mount or a wall mount, all of which hold the flagpole in a vertical position. A pulley system may be available to raise and lower a flag or the user may take the flagpole down to secure a flag to a top position. In any case, the residential category of flagpoles generally makes available to a user the top of the flagpole with relatively little effort, ladders or special lift equipment.

While lighting systems have long been attempted (but with little actual commercial success) for the tops of commercial height flagpoles, little has been proposed for the relatively shorter residential flagpole. First, the need for flag illumination for the residential flagpole is solved far too easily by pointing a cheap outdoor spotlight or flood light at the flag, which is adequate of the relatively short height of the residential flagpole. Most important, night time lighting is rarely desired because of the nuisance effect of such lighting for the home about which it might be arranged or for the neighboring homes.

FIG. 1 shows a generalized depiction of a residential flagpole 10 comprising multiple pipe or cylinder sections 12 and 13 joined at a junction 15 and separateable by pressing button 15. A topmost end of section 12 defines a threaded hole 16 into which a decorative device 17 is removeably fixed by a bolt at a bottom end. Flag 11 is generally removeably fixed to section 12 or to sections 12 and 13 to provide an appropriate display of flag 11. Residential flagpoles are structurally significantly different than their commercial height relatives. Commercial height flagpoles require special engineering due to considerations of harm that might be done if they were to fall, requiring heavy, reinforced tubular columns. In contrast, the residential flagpole is generally formed of lightweight steel or aluminum tubing (and can even be collapsible, as shown in the product at http://www.americanflagsexpress-.com/poles/pole_04.htm), where the relatively low total height and small flags used result in a structure that can support very little additional weight at the flag height. Addition of lighting to residential flagpoles has been generally disfavored for the problem of adding so much weight at the flag height due to the potential of causing a failure of the pole in high winds or harsh weather.

Notwithstanding the lack of potential value for adding night lighting to residential flagpoles, the present inventor has found a surprising and valuable new addition to the unassuming residential flagpole.

SUMMARY OF THE INVENTION

The present invention is an assembly that changes the function of the residential flagpole from a flagpole to a solar powered area light, whereby the flag is removed from connection with the residential flagpole and stored apart from the invention retrofit. The present invention optionally includes a remote control so that a user can select from a number of operational modes for area lighting that are specially adapted to the residential user. The present invention also includes support bar connectors formed from two aluminum or polymer parts that are usable in either a connection of a support bar to the top of the flagpole or from the support bar to the top of a downward directed solar lighting fixture.

The present invention provides a heretofore unknown mobility for an elevated, downward facing, much elevated, solar powered area light. The residential flagpole with the invention solar powered area light is capable of being mounted to a vertical wall by a vertically installed plate having a vertical fixation structure (such as a larger diameter pipe or U-bolts), an automobile wheel laying horizontal on the ground, a larger diameter pipe fixed in the ground or upon a similar support surface. A user may, with one of the mobile mounting means for the residential flagpole, move the invention solar powered area light from front yard (for its use as a security device where its LED's are turned to full illumination by motion detection) to the back yard (as additional lighting for backyard activities in the evening, with a selection of a 3 hour period of full power illumination by the LED's, later turning the LED's off and optionally allowing for motion detection to turn LED's back on for short periods—in case the user wants to later go into the darkened area to retrieve barbeque utensils or other items). Mobility and the ability to change the function of the invention solar powered area light back to a flagpole during daylight hours or for special holidays dramatically expands the functionality the residential flagpole for its owner. For visual integrity, it is preferable that a flag not be attached to the residential flagpole when the invention solar powered area light is attached to it.

BRIEF DESCRIPTION OF THE DRAWINGS

FIG. 1 is side view of a prior art residential flagpole.

FIG. 2 is a side view of the flagpole of FIG. 1 having the capital decoration removed and having the invention solar powered area light connected thereto in its place.

DETAILED DESCRIPTION OF THE INVENTION

Figure 3:
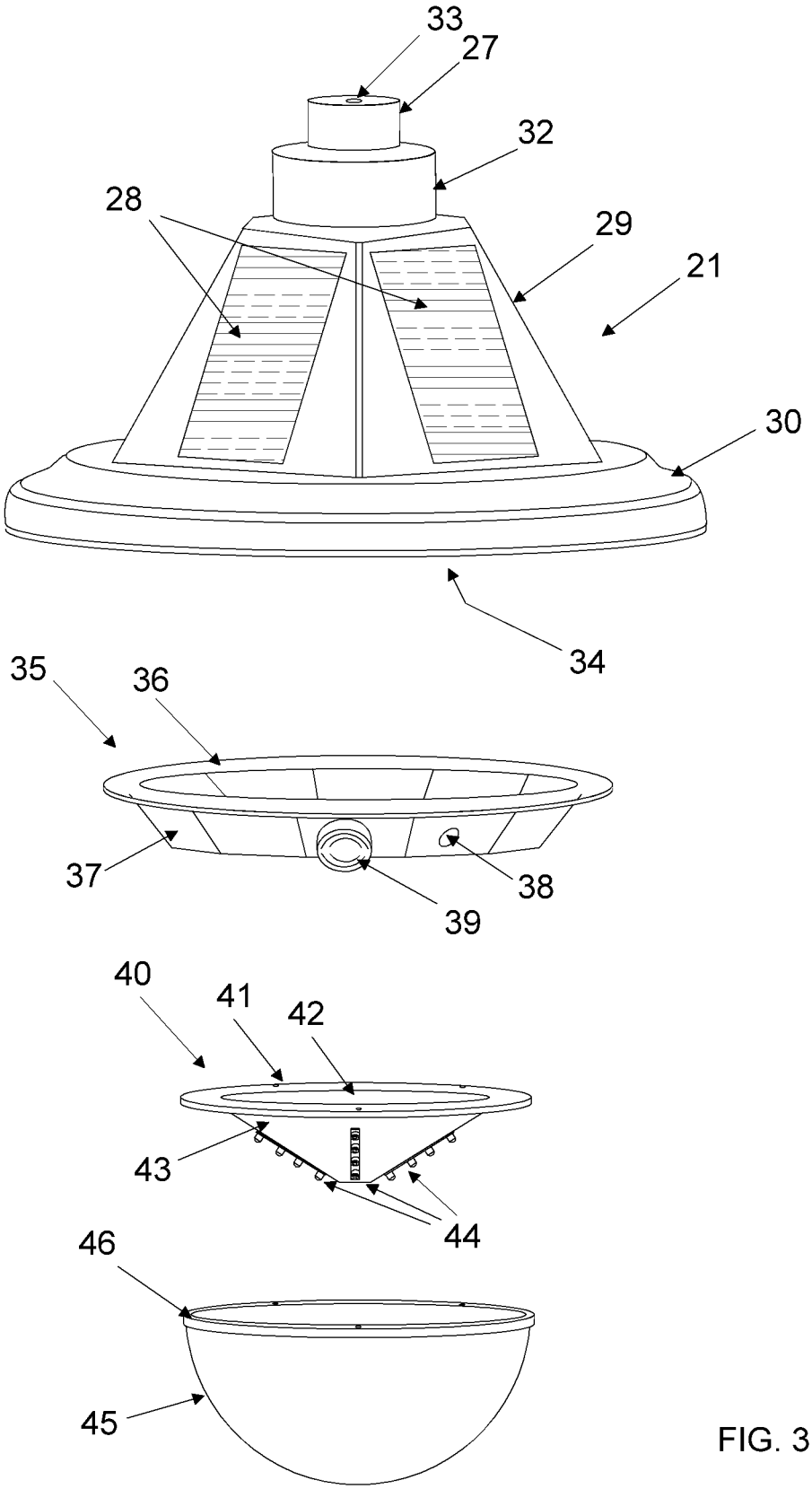
FIG. 3 is an exploded view of major parts of the solar powered area light shown in FIG. 2.

The invention is now discussed with reference to the figures.

FIG. 2 is a side view of the flagpole section 12 of FIG. 1 having the capital decoration removed and having the invention solar powered area light assembly 20 connected thereto in its place. Assembly 20 comprises two identical support bar connectors 22 and 24. The connector 24 connecting assembly 20 to section 12 is removeably connected by way of bolt 25 passing through a central part of connector 24 to the threaded hole in the top of section 12. Connector 24 comprises a cylindrical extension into which is fitted and fixed an end of support bar 23, which extends radially from section 12 and is similarly fitted and fixed to a cylindrical extension of connector 22. Bolt 26 passes through a central part of connector 22 to a threaded hole in the top section 27 of solar powered area light 21. Light 21 comprises a downward facing protective housing having a top section 27, a mid section 32, a hexagonal solar panel section 29 supporting upward and incline-directed solar panels 28, and a broad reflector outer section 30, the combination of which sections define a concave cavity beneath the underside of the protective housing. Transparent hemisphere 31 is indirectly fixed to an underside of the protective housing to isolate LED lights and electrical components from inclement weather.

FIG. 3 is an exploded view of major parts of the solar powered area light assembly 20 shown in FIG. 2, where solar panels 28 are fixed in a position of from 35 degrees to 60 degrees, and more preferably from 40 to 50 degrees, from horizontal. The present inventor has found that solar power gathered by the small solar panels arranged on the outside of the protective housing absorb and store more solar power when there is a greater than 10 degree difference between the normal direction from the solar panel 28 and the direction of the sunlight. The current arrangement of solar panels 28 have been found to optimally gather available sunlight to be stored in batteries secured within the weather-protected cavity 34 of the protective housing. A first attachment to the cavity 34 is 12-sided reflector 35, comprising 12 downward facing sides 37 and defining three screw holes 38 through which are passed screws to attach the support ring 36 of reflector 35 to the underside of the protective housing. Fixed generally equidistant from each other on the downward surfaces of reflector 35 are three or more motion detectors 39, which are capable of detecting motion within about 15 to 75 feet of light 21 when mounted to the top of a flagpole. Motion detectors 39 are directed generally downward and outward on reflector 35 at from 0 to 90 degrees from horizontal so to effectively capture movement of human bodies and thereby turn on the LED's of the invention light 20.

Next in attachment sequence in FIG. 3 is LED support 40 comprising support ring 41 (defining screw holes 42) extending downward to a cone 43 (defining a cone cavity 42) upon which are fixed downward angled LED's 44. The downward facing surfaces of reflector 35 and cone 43 are preferably a reflective surface, which may be white. LED support is fixed by screws at ring 41 to an underside of the ring support 36 of reflector 35, whereafter transparent hemisphere protector globe 45 is fixed with screws to an underside of ring 41 of LED support 43.

Figure 5:
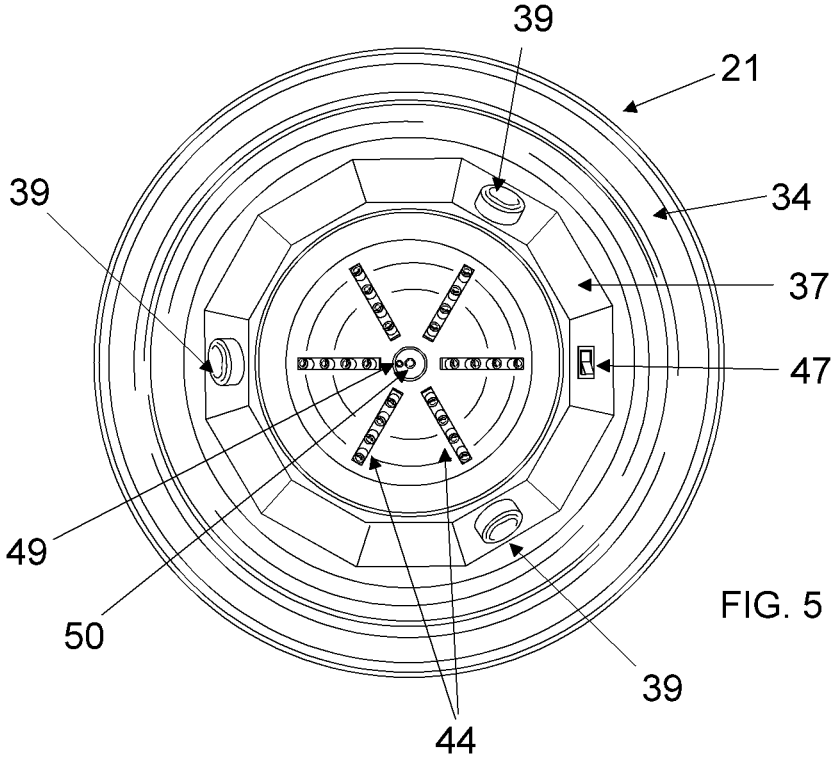
FIG. 5 is a bottom view of the solar powered area light shown in FIG. 2 with a transparent protective hemisphere removed.

The above described LED's and solar panels are connected by wires to an input/output unit of a light microprocessor, which further connects with a infrared or wireless communication module by which the light microprocessor of the invention light 21 receives signals from a remote control held by a remote user. As shown in FIG. 5, the input/output unit further is connected with the motion detectors 39 (FIG. 5), local on/off switch 47 (for manually turning the LED's on or off, where turning switch 47 to "off" does not affect in one embodiment charging of solar batteries by the solar panels), element 49 (for determining whether ambient light is sufficiently low or high to respectively turn the LED's on or off, or, more preferably, a red LED that is turned on when stored power in the solar batteries is below a predetermined minimum level required for powering the LED's), solar power storage batteries, and infrared receiver 50 (optionally for receiving communications from the remote control if wireless communications are by way of infrared signals; more preferably, infrared receivers shall be installed adjacent to motion detectors 39 within the same housing). The light microprocessor further comprises a CPU, clock, and memory operating under a control program to, among other functions, monitor power in solar power storage batteries, motion around light 21, light level in a direction centrally down from light 21, to communicate with a remote control device, to store operating parameters such as on/off triggering light levels and command signals from the remote control device. The light microprocessor is preferably fixed to a printed circuit board fixed within a weather-protected portion of the underside of the protective housing.

Figure 4:
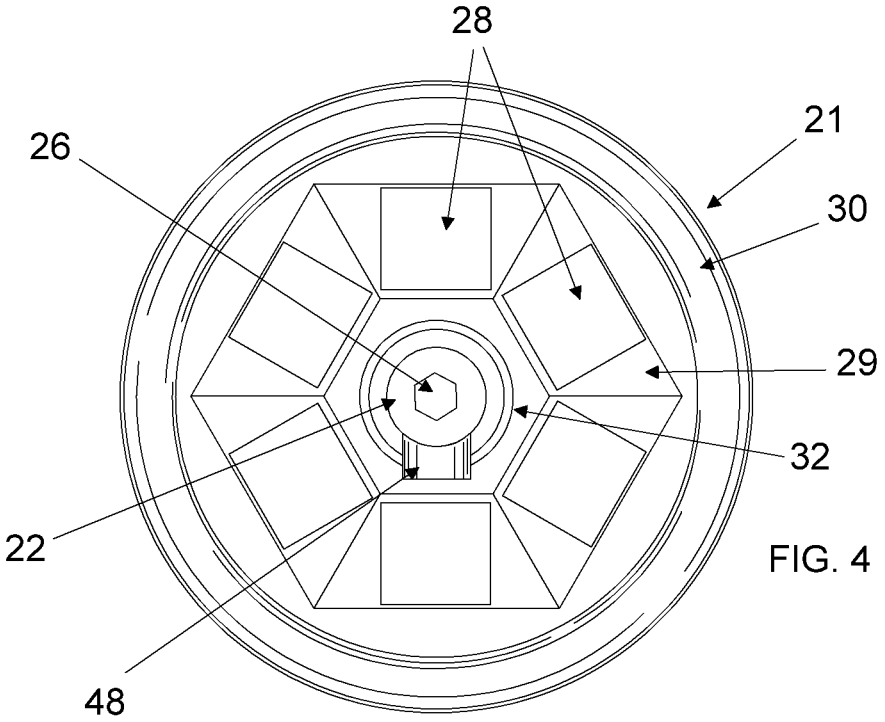
FIG. 4 is a top view of the solar powered area light shown in FIG. 2 with support bar connector fixed to its top end.

FIG. 4 is a top view of the solar powered area light shown in FIG. 2 with support bar connector 22 fixed to its top end section by bolt 26.

The above assembly 20 is preferably very lightweight of from 0.75 to 5 pounds (more preferably from 1.5-3 pounds) maximum weight so that a residential flagpole is not dangerously overburdened to change the function of the flagpole from a flag display device to an elevated, solar powered area lighting device by simply removing the capital decoration of the flagpole and using bolt 25 (as in FIG. 2) to attach assembly 20 to the top of the flagpole.

Figure 6:
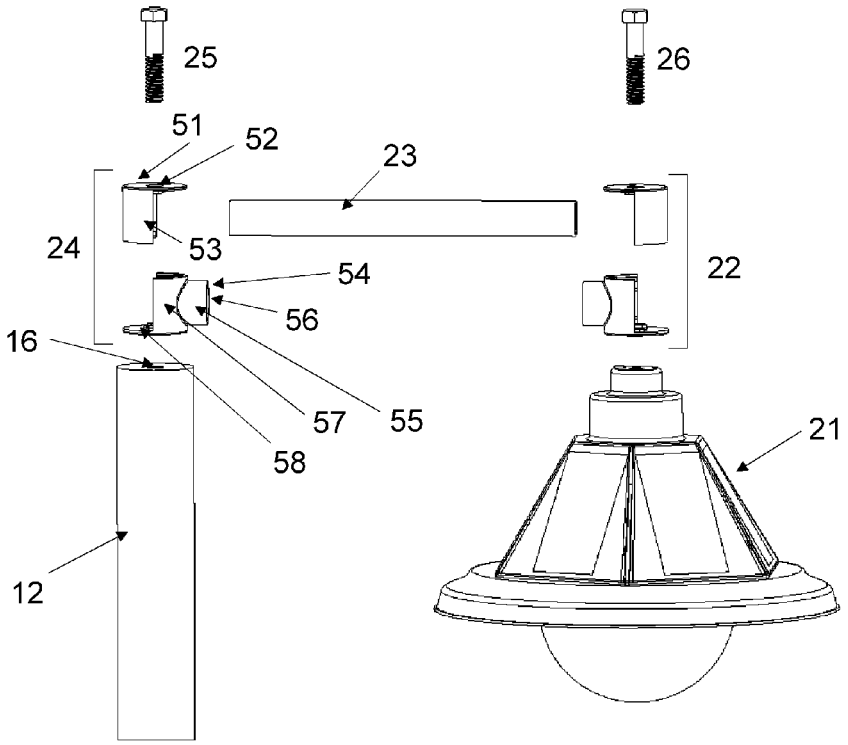
FIG. 6 is the solar powered area light shown in FIG. 2 showing an exploded view of the two support bar connectors.

The user of the residential flagpole can change its desired use from display of a flag to an area lighting structure in minutes. While connectors 22 and 24 can be formed of solid, molded pieces, the present inventor has provided a unique combination of interoperable connectors with a lightweight, hollow construction. FIG. 6 is the solar powered area light assembly 20 shown in FIG. 2 showing an exploded view of the two support bar connectors 22 and 24. Connector 24 is now discussed in more detail, but the same discussion similarly applies to connector 22. Connector 24 comprises a cap housing 51 having a cap plate 52 from which extends downward a half cylinder wall 53 open at a bottom area. The mating piece to cap housing 51 is support bar housing 54, which is basically the same as cap housing 51 with a support bar cylindrical extension 55 with an open end 56 that extend horizontally from the half cylinder wall 57 that extends up from cap plate 58. Housings 51 and 54 are joined by screws, defining a hollow interior space through which the shaft of bolt 25 extends to bolt connector 24 to the top end of section 12 at threaded hole 16. Similarly, the housings of connector 22 also are secured together by screws, defining a hollow interior space through which the shaft of bolt 26 extends through connector 22 to the top end of section 27 at threaded hole 33 (FIG. 3).

Figure 7:
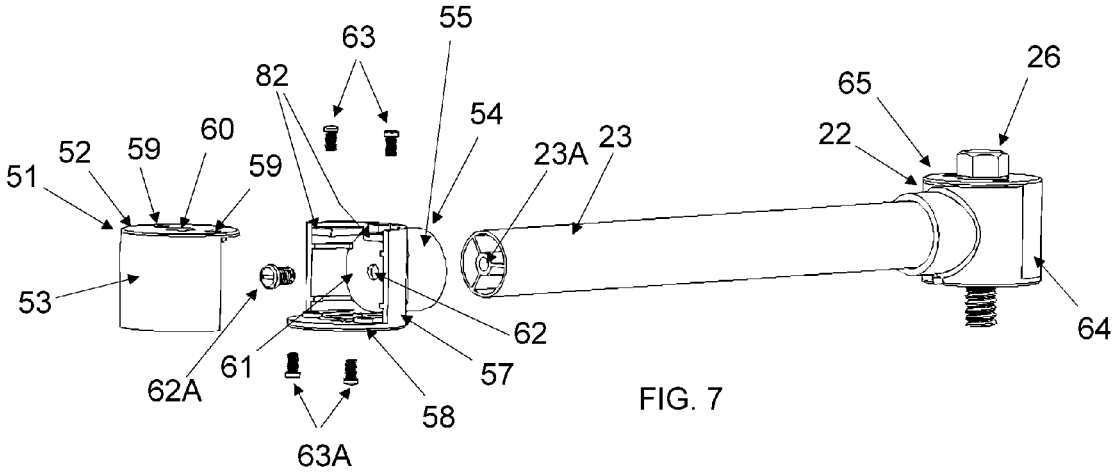
FIG. 7 is a perspective and exploded view of a support bar connector and an end view of a support bar for the solar powered area light shown in FIG. 2.

FIG. 7 is a perspective and exploded view of a support bar connector 24 and an end view of a support bar 23 for the solar powered area light assembly 20 shown in FIG. 2. Connector 24 has a cap housing 51 with screw holes 59 and a bolt hole 60. Support bar housing 54 is shown with a bolt plate wall 61 having a bolt hole 62 through which bolt 62A is inserted and extend through cylindrical extension 55 to threaded core cylinder 23A to thereby fix support bar housing 54 to support bar 23. Thereafter, cap housing 51 is aligned and mated with support bar housing 54 and screws 63 are inserted though screw holes 59 and fixed to screw holes in flanges 82. Similarly, screws 63A are inserted though screw holes in the cap plate 58 and fixed to screw holes in flanges extending from half cylinder wall 53, similar to the flanges 82 in the support bar housing 54. Connector 22 is identically formed and secured together by way of cap housing 64 and support bar housing 65.

Figure 8:
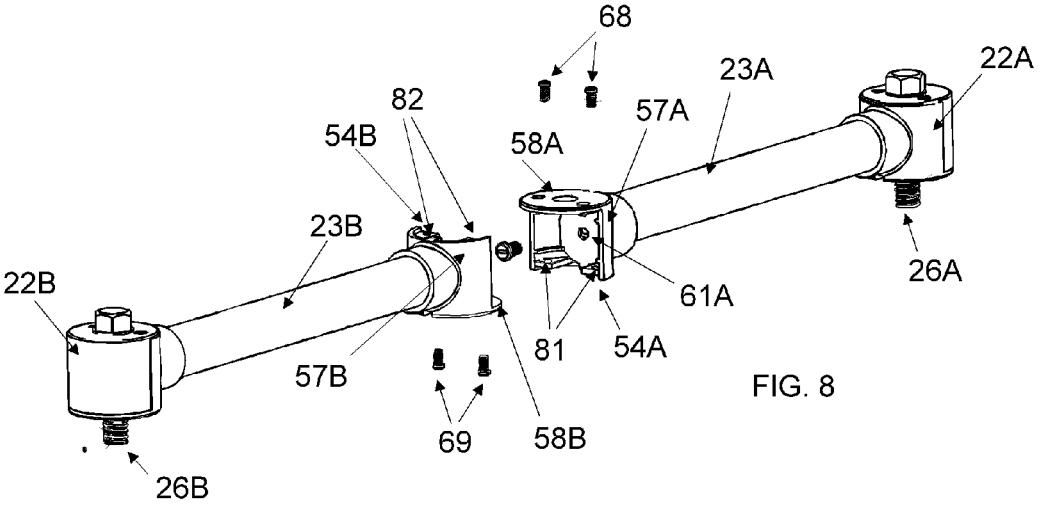
FIG. 8 shows a perspective and separated view of two assemblies of support bar connector and support bar of FIG. 7 with a cap housing removed so that the two assemblies can be joined to provide a flagpole with two downward facing the solar powered area lights shown in FIG. 2.
Figure 9:
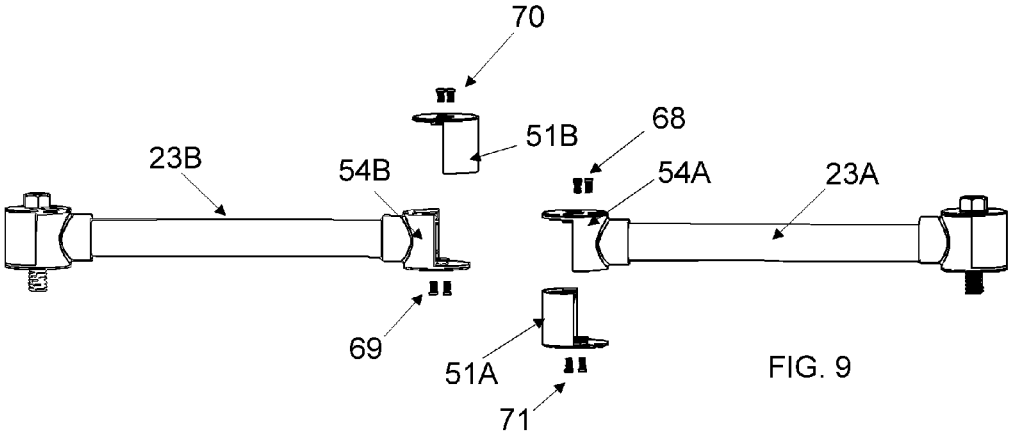
FIGS. 9 and 10 respectively show exploded and assembled side views of the two assemblies of FIG. 8 having cap housings instead of joining the two assemblies as shown in FIG. 8.
Figure 10:
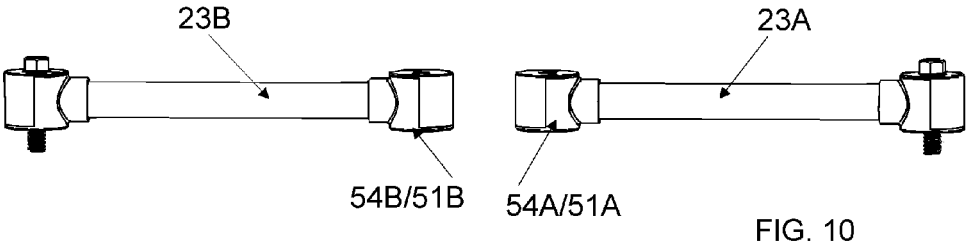
Figure 11:
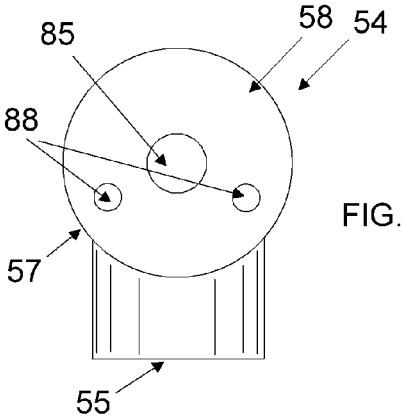
FIGS. 11, 12, 13 and 14 are respectively top, bottom, rear and front views of the support bar housing of FIG. 7.

FIG. 8 shows a perspective and separated view of two assemblies of support bar connector and support bar of FIG. 7 with a cap housing eliminated so that the two assemblies can be joined to provide a flagpole with two downward facing the solar powered area light assemblies 20 shown in FIG. 2. Connectors 22A and 22B of FIG. 7 correspond to connector 22 of FIG. 7. Support bars 23A and 23B correspond to support bar 23 of FIG. 7. Bolts 26A and 26B correspond to bolt 26 of FIG. 7. Support bar housings 54A and 54B correspond to the support bar housing 54 of FIG. 7. In FIG. 8, support bar housing 54B has been rotated about an axis of support bar 23B by 180 degrees so that support bar housings 54A and 54B may be joined in the same manner as that described for cap housing 51 and support bar housing 54 in FIG. 7. Referring again to FIG. 8, screws 68 are inserted though screw holes in the cap plate 58A and fixed to screw holes in flanges 82 extending from half cylinder wall 57B. Further, screws 69 are inserted though screw holes in the cap plate 58B and fixed to screw holes in flanges 81 extending from half cylinder wall 57A. Bolt 25 of FIG. 6 then is inserted through bolt holes in cap plates 58A and 58B to engage threaded hole 16 as in FIG. 6. Further, bolts 26A and 26B are each connected with a solar powered area light 21 as in FIG. 6, thereby providing two area lights for a top of a residential flagpole by way of identically formed support bars, four support bar housings and two cap housings. The present invention using these connector housings can, as shown in FIGS. 9 and 10 be transformed by way of cap housings 51A and 51B into two separate support bar and connector assemblies for two residential flagpoles.

Figure 12:
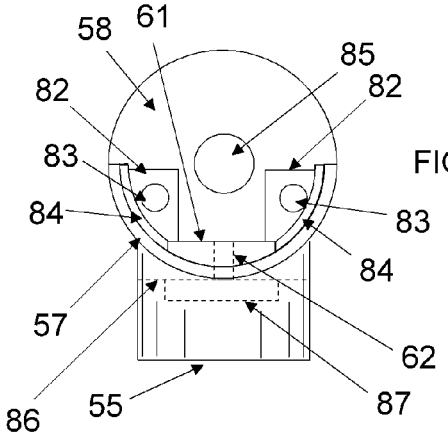
Figure 13:
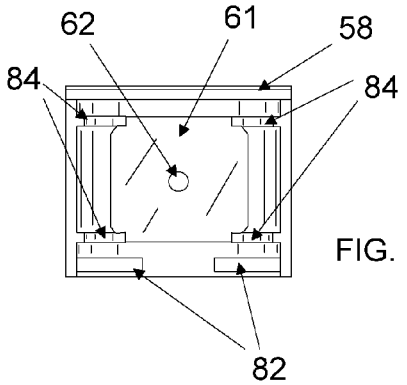
Figure 14:
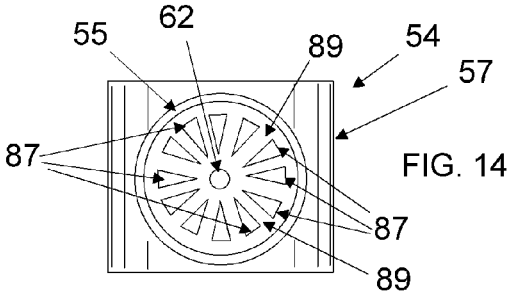

FIGS. 11, 12, 13 and 14 are respectively top, bottom, rear and front views of the support bar housing 54 of FIG. 7, which comprises cylindrical extension 55 extending from wall 57 and adapted to receive an end of a support bar through its open distal end. Cap plate 58 defines bolt hole 85 and screw holes 88, which correspond respectively in function to bolt hole 60 and screw holes 59 of FIG. 7. Flanges 83 extend inward from wall 57 and define threaded screw holes 83 which are adapted to receive screws 63 of FIG. 7. Ribs 84 extend in from wall 57 and terminate in a flat bolt surface 61 that defines a bolt hole 62, through which bolt 62A of FIG. 7 is inserted to further extend through extension 55 and threadedly be fixed to support bar 23. FIGS. 12 and 14 show that a sealed end of extension 55 comprises a flat surface 86 from which 12 raised lock tabs 87 extend, where each pair of adjacent lock tabs 87 define a lock slot 89, which lock slots are defined to be at 30 degrees apart from each other radially around a central axis of extension 55.

Figure 15:
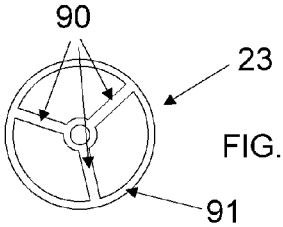
FIG. 15 is an end view of the support bar of FIG. 7.
Figure 16:
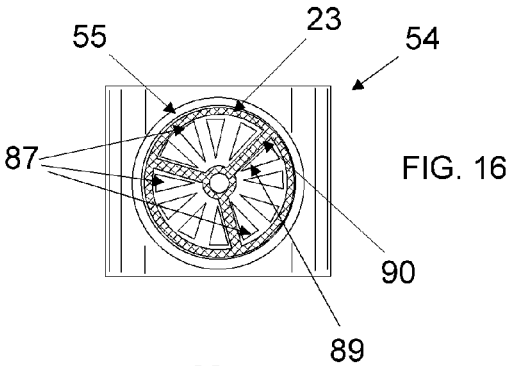
FIG. 16 shows a section of the support bar of FIG. 15 secured between raised lock tabs within the cylindrical extension of the support bar housing of FIG. 14.
Figure 17:
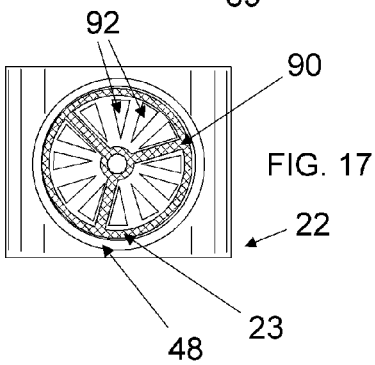
FIG. 17 shows a section of the support bar of FIG. 15 secured between raised lock tabs within the cylindrical extension of the other support bar housing of FIG. 7.

FIG. 15 is an end view of the support bar 23 of FIG. 7, showing the outer pipe 91 has internal flanges 90 arranged 120 degrees apart from each other around a central axis of the support bar 23. FIG. 16 shows a section of the support bar 23 of FIG. 15, where ends of internal flanges 90 are engaged in three of the lock slots 89 to prevent support bar 23 from rotating relative to support bar housing 54. Similarly, FIG. 17 shows a section of the support bar 23 of FIG. 15, where ends of internal flanges 90 are engaged in three of the lock slots between adjacent lock tabs 92 to prevent support bar 23 from rotating relative to support bar housing of connector 22 of FIG. 7. The fixing of support bar 23 as shown in FIGS. 16 and 17 assure that connectors 22 and 24 in FIG. 7 have their respective engaged bolts oriented vertically downward. This assures that the invention light assembly is oriented vertically downward at the same angle of the flagpole to which it is affixed.

Figure 18:
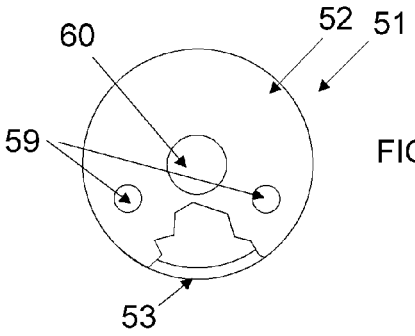
FIGS. 18, 19 and 20 respectively show top, bottom and rear views of a cap housing.
Figure 19:
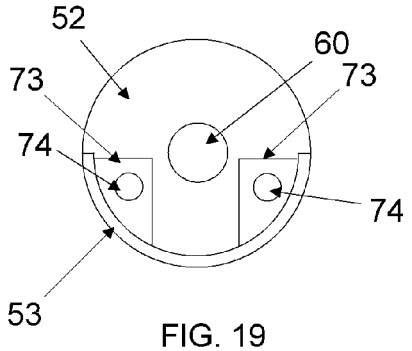
Figure 20:
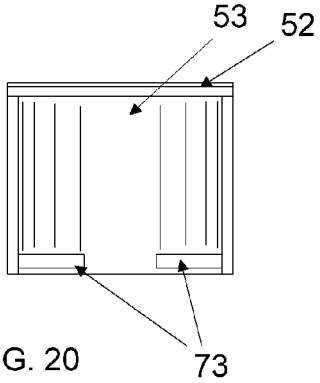

FIGS. 18, 19 and 20 respectively show top, bottom and rear views of a cap housing 51. Cap plate 52 defines a bolt hole 60 and screw holes 59 (a broken away section in FIG. 18 shows wall 53). Flanges 73 extend inward from wall 53 and define threaded screw holes 74, which receive screws 63A in FIG. 7.

Figure 21:
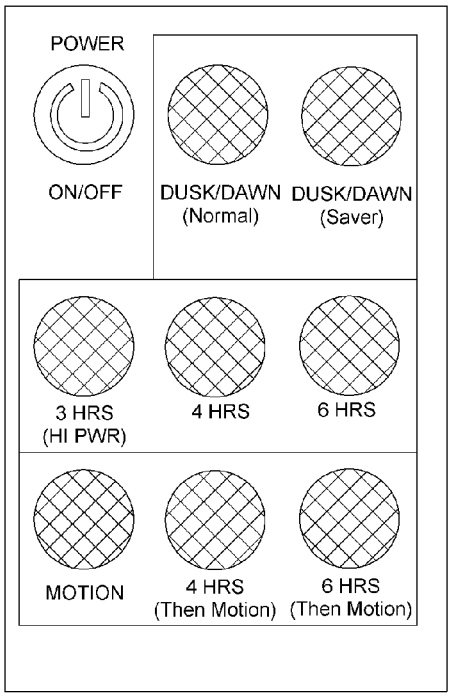
FIG. 21 is a top view of one form of a remote control device for the solar powered area light shown in FIG. 2.

FIG. 21 is a top view of one form of a remote control device 95 for the solar powered area light shown in FIG. 2. Device 95 comprises a small hand-held housing enclosing a battery which is connected with a device input/output unit of a device microprocessor, which further connects with a infrared or wireless communication module through which the device microprocessor communicates wirelessly with the light microprocessor of the invention light 21. The device input/output unit further is connected with the user interface of pressure sensitive buttons shown in FIG. 21.

Referring to FIG. 21, a POWER button when depressed by a remote user transmits a signal to light microprocessor causing it to turn the invention solar powered area light on, where a second activation of that button causes the invention solar powered area light to be turned off. Alternatively, a user may use the on/off switch 47 of FIG. 5 to turn the entire invention solar powered area light on or off. In a preferred embodiment, if the on-off switch at the invention area light is turned off, communication with device 95 and invention light 21 is also turned off, rendering device 95 incapable of delivering signals to invention light 21.

In a preferred form of the invention, the invention solar powered area light is turned off or on, solar rays absorbed by solar panels are converted to electrical energy and stored in solar storage batteries in the protective housing. The light microprocessor periodically detects and stores a value indicating power converted from sunlight stored in the solar storage batteries. The control program compares that level of stored electrical power in the solar storage batteries with predetermined and stored values, which comparisons result in the light microprocessor acting to turn the LED's entirely off, to turn some or all of the LED's on, or to turn the LED's on with various levels of electrical power delivered to the LED's turned on so that brightness is variable depending upon a desired lighting level for the invention area light.

The invention light microprocessor also receives input that indicates ambient light levels and stores that value for comparison to a trigger value. If the sensed ambient light is below or above the trigger level, the light microprocessor may automatically act to respectively turn on or off the LED's or to use the results of said comparison in combination with other input or comparisons to turn LED's on or off. Such detection of ambient light may be (1) by a light sensor or (2) by way of detection of a rate of storage of converted electrical power from the solar panels and comparison of that rate with a predetermined and stored value, where detection that solar power charging is below a desired rate is an indication that ambient light levels are low enough so that lighting the LED's of the invention area light would be an aid to persons in the area.

Preferably, if the light detector of the invention solar powered area light senses ambient light level is above a predetermined value stored in the memory of the light microprocessor, the light microprocessor may automatically act to turn the LED's off or to use the results of that comparison with other input or comparisons. Alternately, if that sensed light level is below a predetermined value, the light microprocessor will refer to stored commands relevant to turning the LED's on.

If a user of the device 95 of FIG. 21 presses the button Dusk/Dawn (Normal), a command signal is be transmitted to the invention solar powered area light so that the LED's turn on or off respectively if the sensed light level was below or above the predetermined value, i.e., generally at night time. In another form of the invention, if a user presses the on/off switch 47 of FIG. 5 to the "on" position, the invention solar powered area light acts in default in the same way as if a remote user had pressed the button Dusk/Dawn (Normal) of the device 95 of FIG. 21.

If a user of the device 95 of FIG. 21 presses the button Dusk/Dawn (Saver), a command signal will be transmitted to the invention solar powered area light so that the LED's turn on to a reduced power level than that delivered to the LED's when the command of the Dusk/Dawn (Normal) button is pressed, but whereby the LED's are lighted for the same periods of time. In another option for this mode of operation, when motion is detected by the motion detector of the invention light 21, the reduced power, reduced light level is increased to full power level for a predetermined period of time, after which if no motion is detected the power level to the LED's will be reduced and the LED's will be dimmed again.

The mode of operation for invention light 21 after pressing the Dusk/Dawn (Saver) button allows the user to preserve power and have a lower level of lighting for a longer period of time while no one is present in the motion detection range. In another mode of operation for this button, a user may not need the invention light 21 to be on all night, but may desire it to be on for some time after sunset and to be certain that it will be available for use in the early morning before sunrise. If the user selects this mode in the evening, the user will be certain that pressing the POWER button in the morning will cause the invention light to be lighted for the user's benefit.

If a user of the device 95 of FIG. 21 presses the button Motion, a command signal will be transmitted to the invention solar powered area light so that the LED's turn on in low light conditions only if motion detectors detect motion. This mode allows the user to preserve power and have the LED's turned on only for a predetermined period of time after motion is detected (i.e., for 3 minutes, 5 minutes or 30 minutes), after which the LED's are turned off to conserve power. If a user of the device 95 of FIG. 21 presses the buttons 4 HRS (Then Motion) or 6 HRS (Then Motion), the light microprocessor will act to cause the LED's to be lighted for a period of 4 hours or 6 hours after detecting a low light condition and then turn the LED's off, operating as if the Motion button had been pressed.

If a user of the device 95 of FIG. 21 presses the buttons 3 HRS (HIGH PWR), 4 HRS, or 6 HRS, the light microprocessor will act to cause the LED's to be lighted for a period of 3 hours, 4 hours or 6 hours at their highest power level for highest illumination level and then the LED's will be turned off until after the light microprocessor senses first a high level of ambient light and thereafter another low level of ambient light. The light microprocessor comprises a clock which will determine time periods to accomplish the objects of this invention, especially where timed responses are required for lighting of the LED lights.

In an alternate operational mode of the invention area light, the on/off switch in the "on" position causes the wireless communications module to operate and receive command signals from the handheld wireless device, where each last-received command signal is stored in the memory of the light microprocessor. When the on/off switch is changed to the "off" position, all received command signals are erased or ignored by the light microprocessor, whereby at the next time the on/off switch is turned "on" a pre-determined default mode for operation of the area light causes the LED's to turn on and off. The default mode may be selected from the above operation modes. Further, if the on/off switch remains in the "on" position, the last received command signal from the handheld wireless device is stored and causes the LED's to turn on or off according to its predetermined functions during all successive periods when the ambient light is low enough to cause the LED's to be turned on.

A support bar of the present invention is preferably from 6 inches to 4 feet long, and more preferably from 1 foot to 3 feet long to accommodate the structural strength of the residential flagpole.

Figure 22:
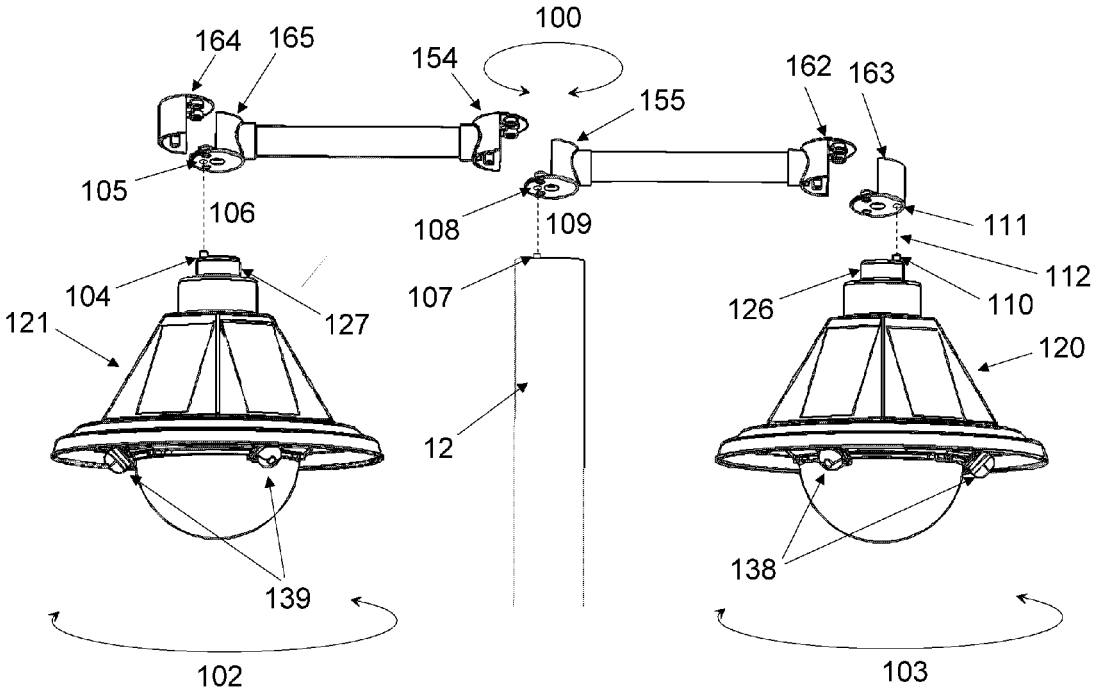
FIG. 22 is a side view of another embodiment of the invention connectors and support bars similar to the assembly of FIG. 8, but providing for rotation prevention means at interface between connectors and top sections of the area lights and at the interface of the connector and top of the flagpole.

FIG. 22 is a side view of another embodiment of the invention connectors and support bars similar to the assembly of FIG. 8, but providing for rotation prevention means at interface between connectors and top sections of the area lights and at the interface of the connector and top of the flagpole. The distal connectors shown are formed from cap housings 163 and 164 respectively adapted to be connected by screws to support bar housings 162 and 165. The flagpole connector is formed from support bar housings 154 and 155. Each of the housings has an anti-rotation peg hole defined in its cap plate, for instance housings 155, 163 and 165 each define respectively anti-rotation peg holes 111, 108, and 105, each of which respectively are adapted to receive into them anti-rotation pegs 110, 107 and 104 (along paths 112, 109 and 106). When the respective housings of the connectors are joined by screws and the anti-rotation pegs are inserted in the anti-rotation peg holes, the main attachment bolts (such as bolts 25 and 26 in FIG. 6) connect the connectors to either top sections 126 or 127 respectively of lights 120 or 121 or will connect the flagpole connector to the flagpole 12, thereby forming a secure connection whereby lights 120 and 121 cannot be rotated in directions 103 or 102 respectively and the entire assembly above the top of the flagpole 12 cannot be rotated in direction 100 relative to flagpole 12. Thus, said entire upper assembly or lights 120 or 121 cannot be unthreaded or loosened from connections with their attachment bolts by intentional or unintentioned rotation. Such rotation may occur from user transport from one location to another or from thermal expansion or weathering. The anti-rotation means shown in FIG. 22 prevents such rotation that could result in the sensitive area lights falling to the ground and being damaged or hurting someone below them.

Further, the anti-rotation means of FIG. 22, in preventing rotation of area lights 120 and 121 from rotating relative to an axis of the distal connectors, assures that peripherally arranged housings 138 and 139 (which house motion detection sensors, infrared communications receivers, and/or ambient light detection sensors) are locked into a position optimal for motion, infrared communications, and ambient light detection. For FIG. 22, motion detectors, infrared communication receivers, and ambient light detection sensors are preferably combined in housings 138 and 139, which are always pointed in a direction, with respect to a vertical axis of the flagpole, most distant from the flagpole 12. Thus, the flagpole 12 cannot substantially interfere with detection of motion or infrared signals from the handheld remote unit for the invention area lights on flagpole 12.

Figure 23:
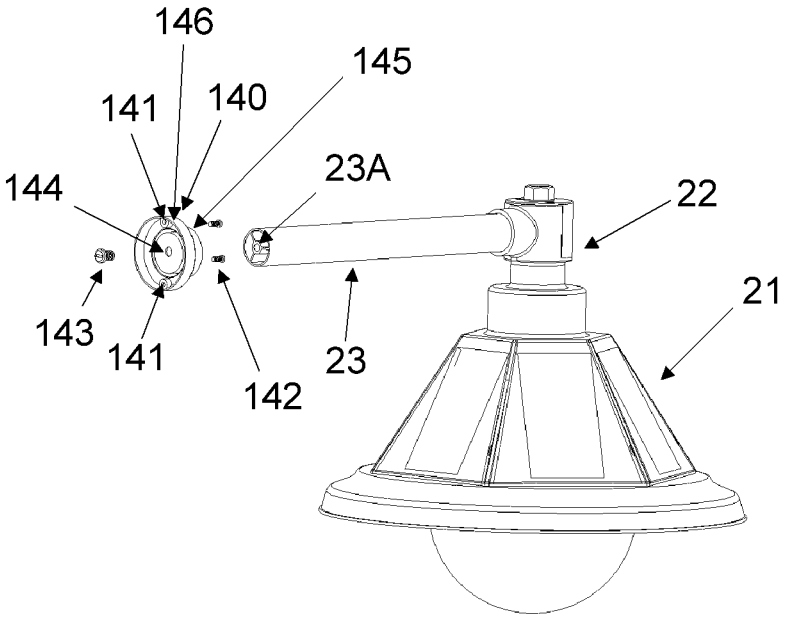
FIG. 23 is a perspective view of the invention area light, a distal connector, a support arm, and a wall connector.

The invention area light can also be fixed to a wall instead of to a top of a flagpole by way of an L-bracket, with a vertical section of the L-bracket fixed to a wall by screws or bolts and a horizontal section of the L-bracket extending away from the wall and defining a bolt hole adapted to receive bolt 25 of FIG. 6, where a threaded nut attached to the threaded end of bolt 25 fixes proximal connector 24 to the L-bracket. Alternately, FIG. 23 is a perspective view of the invention area light 21, a distal connector 22, a support arm 23, and a wall connector 140 in a semi-exploded view. Connector 140 comprises a cylindrical connector 145 extending horizontally from a connector housing 146, in which is defined a bolt hole 144, through which bolt 143 is passed to fix connector 140 to support arm 23 at hole 23A. The entire assembly is then fixed to a wall with the two screws 142 passing though two screw holes 141 defined in housing 146 to connect the entire assembly to a vertical wall surface.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A flagpole and solar powered light conversion assembly comprising:

(a) a flagpole with an attachment structure for attaching a flag at a top section of the flagpole and with connection means for attaching a decorative piece at a top of the top section;

(b) a first connector connected to the connection means;

(c) a support bar extending laterally from the first connector;

(d) a second connector connected to a distal end of the support bar and the second connector connected with a top end of a protective housing;

(e) the protective housing defining a housing axis and a substantial downward concavity on an underside, where an upper surface comprises four or more solar panels fixed substantially equidistant from each other and oriented with a top edge inclination toward the housing axis of from 30 degrees to 60 degrees from vertical;

(f) lights arranged on a reflective and downward facing support secured to the underside of the protective housing, where a transparent cover is fixed to the underside of protective housing beneath the downward facing support to define a weather protected space in the protective housing;

(g) the solar panels having electrical connection with solar storage batteries and a light microprocessor, both fixed within the weather protected space, the light microprocessor operating under a control program to act to turn on or off the lights according to user input from a user interface communicating with the light microprocessor and from input from a light level sensor that detects ambient light;

(h) the first and second connectors are identical and each comprise two housing parts that mate together to form an external housing;

(i) the housing parts are a support bar housing part and a cap housing part, each housing part being generally identical to the other except that the support bar housing part comprises a horizontal cylindrical extension extending from a generally vertical half cylinder wall and where the cylindrical extension is adapted to engage one end of the support bar;

(j) each housing part comprises a cap plate extending inward toward an axis of the half cylinder wall and also from a top or bottom edge of the half cylinder wall, which cap plate defines a bolt hole;

(k) the bolt holes of the housing parts vertically align and are adapted to receive a bolt shaft; and (l) a first bolt is inserted into the bolt hole of the first connector and the bolt fixes the first connector to the connection means.

2. The assembly of claim 1, wherein the support bar is from 6 inches to 4 feet long.

3. The assembly of claim 2, wherein the support bar is from 1 foot to 3 feet long.

4. The assembly of claim 3, wherein a portion of the assembly located at an elevation and spatial orientation above and outward from the connection means weighs from 0.75 to 5 pounds.

5. The assembly of claim 4, wherein a portion of the assembly located at an elevation and spatial orientation above and outward from the connection means weighs from 1.5 to 2 pounds.

6. The assembly of claim 1, further comprising a user interface wherein the user interface comprises an on/off switch, whereby moving the switch to an "on" position causes the light microprocessor to detect an ambient light level and to turn the lights on if the ambient light level is below a predetermined level stored in an onboard memory of the light microprocessor.

7. The assembly of claim 1, wherein the user interface comprises a hand-held remote control device having a housing containing a device microprocessor operating under a device program and connected with a battery, a wireless communication module, and a push button interface, where pressing a first button in the push button interface sends a command signal to a light wireless module connected with the light microprocessor and causes the light microprocessor to detect an ambient light level and to turn the lights on if the ambient light level is below a predetermined level stored in an onboard memory of the light microprocessor.

8. The assembly of claim 7, wherein pressing a second button of the push button interface sends a command signal to the light wireless module connected with the light microprocessor and causes the light microprocessor to detect an ambient light level and to turn the lights on if the ambient light level is below a predetermined level stored in an onboard memory of the light microprocessor or if motion is sensed in one or more motion sensors connected with the light microprocessor.

9. The assembly of claim 8, wherein pressing a second button of the push button interface sends a command signal to the light wireless module connected with the light microprocessor and causes the light microprocessor to detect an ambient light level and to turn the lights on if the ambient light level is below a predetermined level stored in an onboard memory of the light microprocessor and to turn the lights off after a predetermined time period.

10. The assembly of claim 9, wherein pressing a second button of the push button interface sends a command signal to the light wireless module connected with the light microprocessor and causes the light microprocessor to detect an ambient light level and to turn the lights on if the ambient light level is below a predetermined level stored in the light microprocessor and to turn the lights off if a predetermined amount of time has passed, where the predetermined amount of time is a value stored in an onboard memory of the light microprocessor.

11. The assembly of claim 1, wherein a second bolt is inserted into the bolt hole of the second connector and the bolt fixes the second connector to a top end of the protective housing.

12. The assembly of claim 11, wherein the first connector comprises anti-rotation means so that the first connector cannot rotate relative to the flagpole.

13. The assembly of claim 12, wherein the second connector comprises anti-rotation means so that protective housing cannot rotate relative to the second connector.

* * * * *